US007098881B2

(12) United States Patent
Nitta et al.

(10) Patent No.: US 7,098,881 B2
(45) Date of Patent: Aug. 29, 2006

(54) LIQUID CRYSTAL DRIVER CIRCUIT AND LCD HAVING FAST DATA WRITE CAPABILITY

(75) Inventors: Hiroyuki Nitta, Fujisawa (JP); Kazuyoshi Kawabe, Fujisawa (JP); Satoru Tsunekawa, Kodaira (JP); Hirobumi Koshi, Chosei (JP)

(73) Assignee: Hitachi, Ltd., Tokyo (JP)

( * ) Notice: Subject to any disclaimer, the term of this patent is extended or adjusted under 35 U.S.C. 154(b) by 359 days.

(21) Appl. No.: 10/687,992

(22) Filed: Oct. 20, 2003

(65) Prior Publication Data

US 2004/0080522 A1 Apr. 29, 2004

Related U.S. Application Data

(63) Continuation of application No. 09/698,187, filed on Oct. 30, 2000, now Pat. No. 6,661,402.

(30) Foreign Application Priority Data

Oct. 28, 1999 (JP) ..... 11-306419

(51) Int. Cl.
*G09G 3/36* (2006.01)

(52) U.S. Cl. ..... 345/89

(58) Field of Classification Search ..... 345/89, 345/94–100, 204–213, 690–699
See application file for complete search history.

(56) References Cited

U.S. PATENT DOCUMENTS 5,021,774 A 6/1991 Ohwada et al.
5,686,936 A * 11/1997 Maekawa et al. ..... 345/100
5,764,207 A * 6/1998 Maekawa et al. ..... 345/99
5,892,493 A * 4/1999 Enami et al. ..... 345/94
5,959,600 A * 9/1999 Uchino et al. ..... 345/94
6,008,801 A 12/1999 Jeong
6,049,321 A 4/2000 Sasaki
6,151,005 A 11/2000 Takita et al.
6,201,523 B1 3/2001 Akiyama et al.
6,208,550 B1 * 3/2001 Kim ..... 365/145
6,307,532 B1 * 10/2001 Aoki ..... 345/94
6,335,721 B1 1/2002 Jeong
6,373,459 B1 4/2002 Jeong
2001/0033261 A1 * 10/2001 Washio et al. ..... 345/87

OTHER PUBLICATIONS

Chee Tiong Desmond NG, "Smart Antennas for Wireless Applications and Switched Beamforming," Dept. of Information Technology and Electrical Engineering, The University of Queensland, Oct. 2001.
Chee Tiong Desmond NG, "Smart Antennas for Wireless Applications and Switched Beamforming," Electrical Engineering Thesis Project, hhtp://innovexpo.itee.uq.edu.au/2001/projects/s804113.
U.S. Appl. No. 10/354,093, filed Jan. 30, 2003.

* cited by examiner

*Primary Examiner*—Sumati Lefkowitz
*Assistant Examiner*—Rodney Amadiz
(74) *Attorney, Agent, or Firm*—Antonelli, Terry, Stout and Kraus, LLP.

(57) ABSTRACT

A fast-write, high picture-quality LCD (Liquid Crystal Display) compatible with a high-resolution, large-sized liquid crystal panel. An output amplifier circuit of a liquid crystal driver circuit includes an amplifier configuration, which functions as an amplifier that amplifies the predetermined gray-scale voltage for output and as an amplifier that buffers the predetermined gray-scale voltage and outputs with no amplification, and a circuit for switching the above two types of amplifiers. In each horizontal period, a liquid crystal panel is driven by the amplified output for a predetermined period and by the buffered output for the rest of the period. A precharge control circuit is provided to check whether the gray-scale voltage is to be amplified depending upon display data.

33 Claims, 10 Drawing Sheets

Tp:PRE-CHARGE PERIOD
Tg:GRAY-SCALE VOLTAGE WRITE PERIOD

Tp:PRE-CHARGE PERIOD
Tg:GRAY-SCALE VOLTAGE WRITE PERIOD

LIQUID CRYSTAL DRIVER CIRCUIT AND LCD HAVING FAST DATA WRITE CAPABILITY

CROSS-REFERENCE TO RELATED APPLICATIONS

This application is a Continuation application of application Ser. No. 09/698,187, filed Oct. 30, 2000 now U.S. Pat. No. 6,661,402, the entire disclosure of which is hereby incorporated by reference.

BACKGROUND OF THE INVENTION

The present invention relates to a liquid crystal driver circuit which displays data on a liquid crystal display, and more particularly to a liquid crystal driver circuit which applies a drive voltage to a liquid crystal panel at a high speed.

As described in "An 8-bit Digital Data Driver for Color TFT-LCDs", pp. 247–250, in SID DIGEST, 1996, the data driver circuit (liquid crystal driver) of a conventional liquid crystal display (LCD) buffers a liquid crystal application voltage corresponding to display data generated by a digital-to-analog converter (DAC) circuit with the use of an output amplifier circuit before output. The output amplifier circuit, composed of a voltage follower circuit, applies a gray-scale voltage of the DAC circuit directly to the liquid crystal panel pixels to display data.

SUMMARY OF THE INVENTION

In response to an increase in the resolution and size of a liquid crystal panel, the conventional driving method is designed for reducing the charge time (horizontal period) and the liquid crystal panel load but not for quickly writing data on the liquid crystal panel. That is, the conventional method is not compatible with a high-resolution, large-sized liquid crystal panel. Today, the mainstream standard for a liquid crystal panel is XGA (1024×768 dots) and SXGA (1280×1024 dots). In future, the standard for higher-resolution liquid crystal panels, such as UXGA (1600×1200 dots) or QXGA (2048×1536 dots), and QSXGA (2560×2048 dots), will be introduced. Also, the panel size will become larger, from 13-inch or 15-inch panels, which are popular today, to 18-inch or 20-inch panels.

The horizontal period, which is the liquid crystal panel write time, is about 14 μs for the resolution of XGA and about 11 μs for SXGA. The horizontal period is reduced as the resolution increases, that is, about 9 μs for UXGA, about 7 μs for QXGA, and about 5 μs for QSXGA. The liquid crystal panel load also increases as the panel size increases; that is, the load of a 18-inch panel is about 1.2 times higher, and the load of a 20-inch panel is about 1.33 times higher, than that of a 15-inch panel.

Therefore, it is difficult for the conventional driver circuit to write data into a high-load liquid crystal panel in such a short charge time. The picture quality is degraded because of an insufficient write voltage.

It is an object of the present invention to provide a liquid crystal driver circuit and an LCD which quickly write data into a liquid crystal panel with a large load capacity and load resistance to display high quality pictures on a high-resolution, large-sized liquid crystal display.

To solve the above problems, there is provided in the output amplifier circuit of a liquid crystal driver circuit, means for switching between an amplifier circuit that amplifies a predetermined gray-scale voltage for output and an amplifier circuit that amplifies a predetermined gray-scale voltage by a factor of 1 for buffering and outputs it with no amplification. For a predetermined part of the horizontal period, the liquid crystal panel is driven by the amplified output and, for the rest of the period, by the buffered output.

In addition, a pre-charge control circuit is provided to check whether the gray-scale voltage is to be amplified depending upon the display data.

Other objects, features and advantages of the present invention will become apparent from the description of the following embodiments of the invention taken in conjunction with the accompanying drawings.

DETAILED DESCRIPTION OF THE EMBODIMENTS

An embodiment of a dot inversion drive method of a liquid crystal display will be described with reference to FIGS. 1, 2, 9, and 10.

Figure 1:
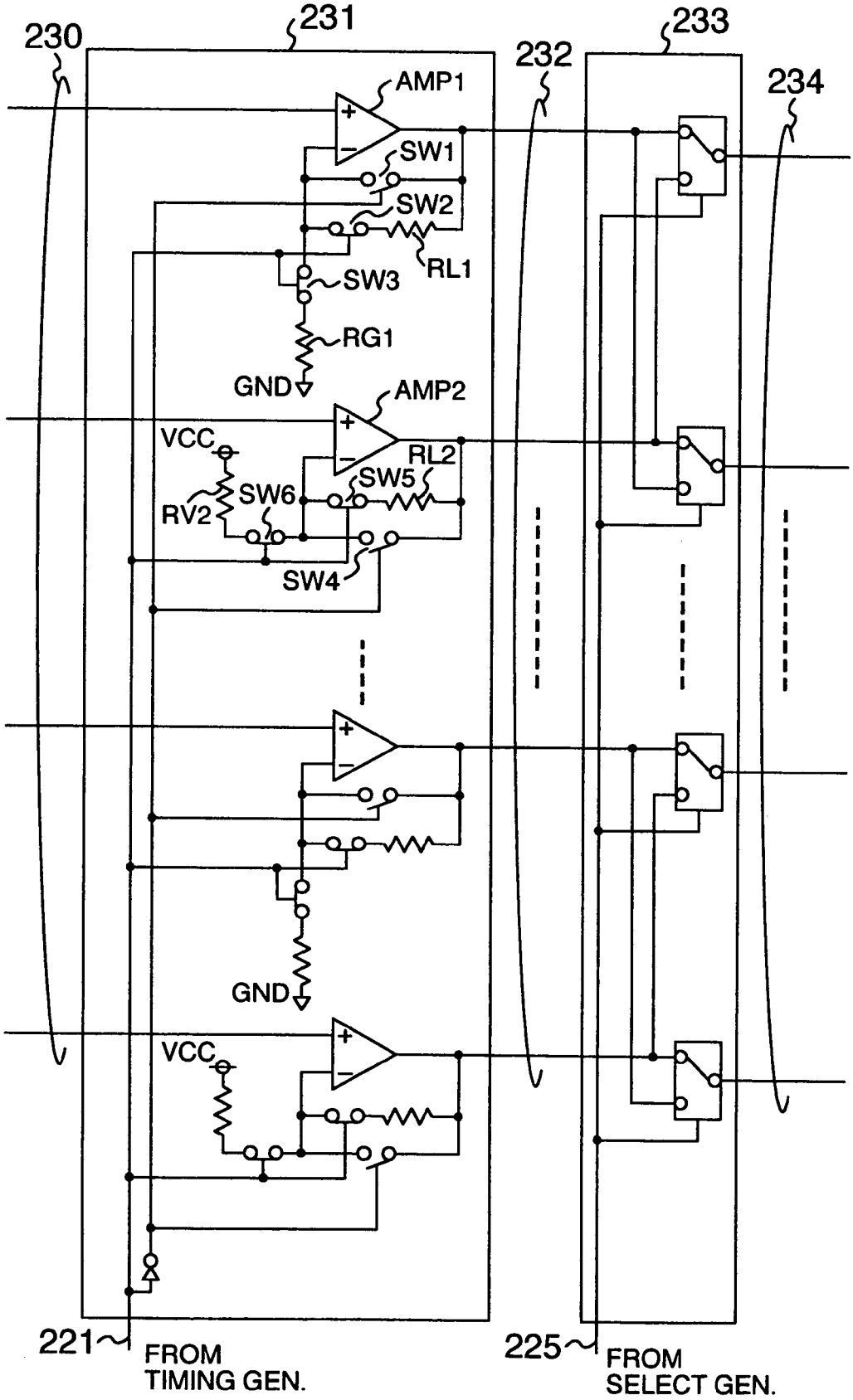
FIG. 1 is a block diagram showing an output amplifier circuit to which the present invention is applied.
Figure 2:
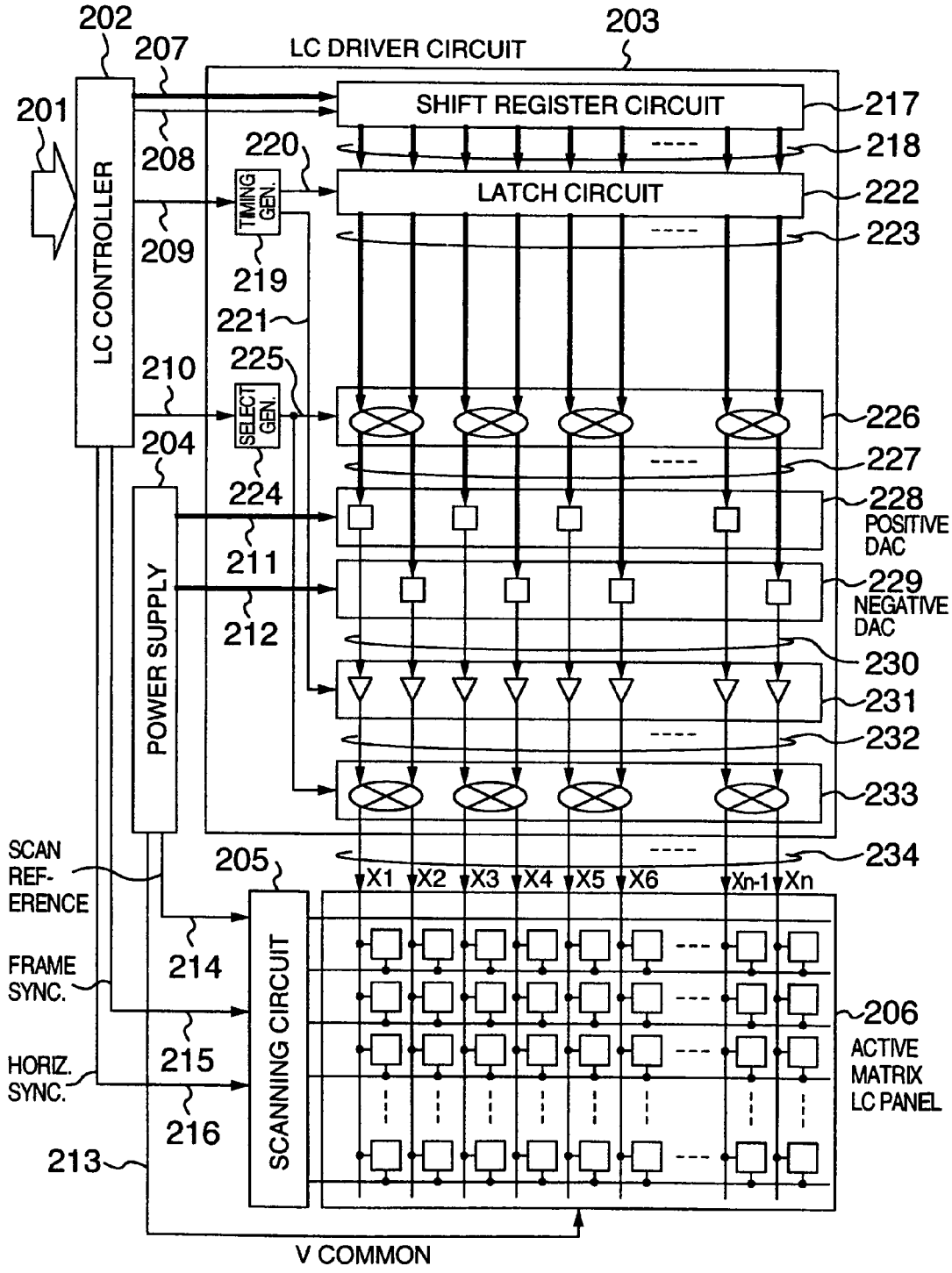
FIG. 2 is a block diagram showing an embodiment of an LCD.

FIG. 1 shows a configuration of an output circuit within a liquid crystal driver circuit, and FIG. 2 shows a configuration of the liquid crystal driver circuit. In the Figures, numeral 201 indicates a display signal set transferred from a system unit, numeral 202 indicates a liquid crystal controller which converts the display signal set 201 to the synchronizing signal and display data of a liquid crystal driver circuit, numeral 203 indicates a liquid crystal driver circuit which applies a driving voltage corresponding to the display data to the liquid crystal panel, numeral 204 indicates a power supply circuit which generates a gray-scale voltage and reference voltage of the liquid crystal panel, numeral 205 indicates a scanning circuit which performs line-sequential selection for the liquid crystal panel, and numeral 206 indicates an active matrix liquid crystal panel. Numeral 207 indicates display data converted for use by the liquid crystal driver circuit, numeral 208 indicates a data transmission clock synchronizing with the display data 207, numeral 209 indicates a horizontal synchronizing signal which indicates the horizontal period, numeral 210 indicates an alternately switching signal which indicates the alternately switching timing of liquid crystal driving, numeral 211 indicates a positive-polarity gradation reference voltage whose alternately switching polarity of the liquid crystal driving voltage is positive, numeral 212 indicates a negative-polarity gradation reference voltage whose alternately switching polarity of the liquid crystal driving voltage is negative, numeral 213 indicates a common polarity voltage Vcom which is the reference voltage of the common polarity of the liquid crystal panel, numeral 214 indicates the scan reference voltage of the scan driving voltage output by the scanning circuit, numeral 215 indicates a frame synchronizing signal which indicates a frame period, and numeral 216 indicates a scan horizontal synchronizing signal which indicates the scan horizontal period timing. Here, the alternately switching polarity is defined as a voltage polarity that exhibits a positive-polarity voltage or a negagtive-polarity voltage applied to an LC pixel or LC pixels. Numeral 217 indicates a shift register circuit which sequentially acquires display data within the liquid crystal driver circuit 203, numeral 218 indicates a display data bus to which data is output from the shift register, numeral 219 indicates a control circuit which generates a timing signal for use in the liquid crystal driver circuit from the horizontal synchronizing signal 209, numeral 220 indicates a horizontal latch signal which latches the display data of the display data bus 218 to a latch circuit 222 at the same time, numeral 221 indicates a pre-charge timing signal which indicates the pre-charge period of an output amplifier circuit 231, numeral 223 indicates the output data from the latch circuit 222, numeral 224 indicates a control circuit which generates a selection signal 225 from the alternately switching signal 210, numeral 226 indicates a selection circuit which selects the display data of an output terminal corresponding to a neighboring pixel, numeral 227 indicates selection data, numeral 228 indicates a DAC circuit which generates a positive-polarity gray-scale voltage corresponding to the selection data 227, numeral 229 indicates a DAC circuit which generates a negative-polarity gray-scale voltage corresponding to the selection data 227, numeral 230 indicates a gray-scale voltage generated by the DAC circuits 228 and 229, numeral 231 indicates the output amplifier circuit, numeral 232 indicates a gray-scale voltage, numeral 233 indicates a selection circuit which selects a gray-scale voltage corresponding to the neighboring output terminal, and numeral 234 indicates a liquid crystal application voltage.

FIG. 1 shows the detailed circuit configuration of the output amplifier circuit 231 in which the selection circuit 233 selects one of paired amplifier circuits, AMP1 and AMP2. As shown in the figure, three switches, SW1, SW2, and SW3 are switched in each amplifier to perform the amplification function and the voltage follower function.

Figure 9:
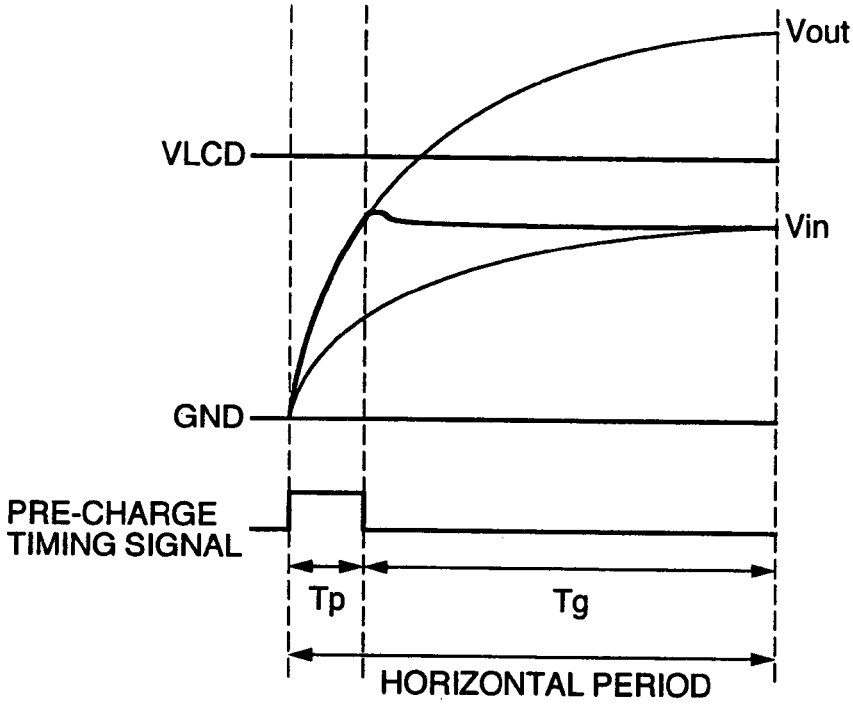
FIG. 9 is a diagram showing a driving waveform.
Figure 10:
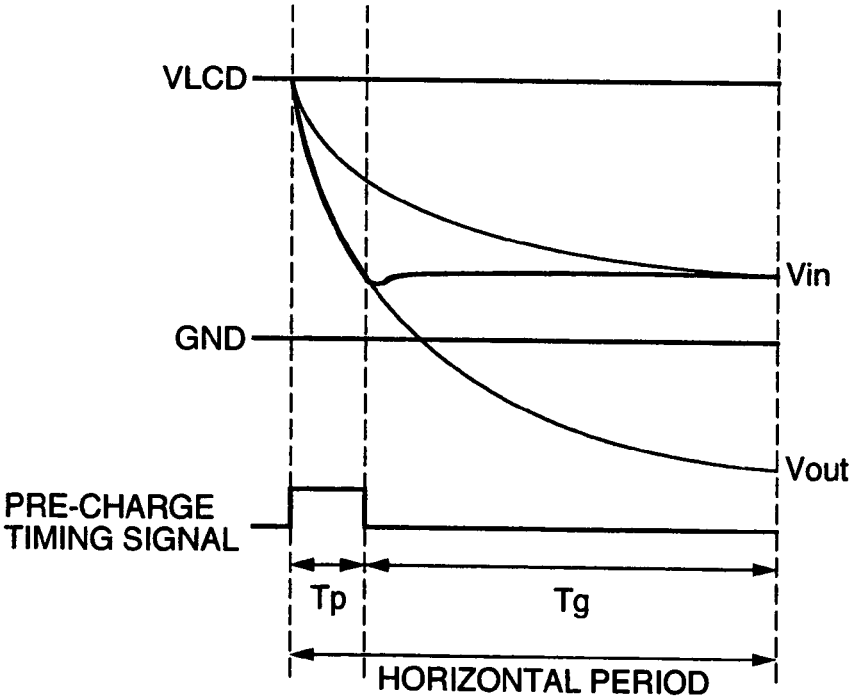
FIG. 10 is a diagram showing a driving waveform.

FIG. 9 shows one horizontal period of the driving waveform when the positive polarity gray-scale voltage is written, while FIG. 10 shows one horizontal period of the driving waveform when the negative polarity gray-scale voltage is written. As shown in FIG. 9, the pre-charge period Tp and the gray-scale voltage write period Tg are switched according to the pre-charge timing signal 221. During the pre-charge period Tp, write operation is performed along a characteristic curve of a voltage (Vout) higher than the gray-scale voltage, which characteristic is determined by the resistors RL1 and RG1 to allow high-speed write operation for the gray-scale voltage (Vin). During the gray-scale voltage write period Tg, a predetermined gray-scale voltage (Vin) is written to thereby write a liquid crystal application voltage corresponding to the display data at a high speed. The optimum value of the pre-charge period Tp is determined depending on the load of the liquid crystal. Also, as shown in FIG. 10, the pre-charge period and the gray-scale voltage write period are switched according to the pre-charge timing signal 221. During the pre-charge period, data write operation is performed along a characteristic curve of a voltage (Vout) lower than the gray-scale voltage, which characteristic is determined by the resistors RL2 and RV2 and so the high-speed write operation is performed for the gray-scale voltage (Vin). During the gray-scale voltage write period, a predetermined gray-scale voltage (Vin) is written and so, the liquid crystal application voltage corresponding to the display data may be written at a high speed. In the description below, the driving waveforms shown FIGS. 9 and 10 are used to describe the above operation. Therefore, when FIGS. 9 and 10 are referenced later, the detailed description given above is omitted to avoid duplication.

Next, the liquid crystal panel driving operation will be described. In FIG. 2, in response to the display signal set 201 sent from a system unit (not shown) such as a personal computer, the liquid crystal controller 202 generates the timing signal and the control signal for the liquid crystal driver circuit. The display data 207 is serially sent to the liquid crystal driver circuit 203, two RGB pixels at a time, in synchronization with the data transmission clock 208. When the number of output gradations of the liquid crystal driver circuit 203 is 256, a total of 48 bits (8-bit RGB×2 pixels) of display data are sequentially sent. The liquid crystal driver circuit 203 sequentially acquires the display data 207 on the data transmission clock 208 to form one line of display data. One line of data, once acquired, is latched by the horizontal latch signal 220 to the latch circuit 222, one line at a time, during the horizontal period. The selection circuit 226 selects the display data of two pixels corresponding to the neighboring output in accordance with the alternately switching timing. The DAC circuit 228 generates the positive-polarity gray-scale voltage, while the DAC circuit 229 generates the negative-polarity gray-scale voltage. Therefore, the selection circuit 226 selects display data depending upon whether the neighboring output is in the positive polarity or negative polarity. Because the output amplifier circuit 231 outputs one of the positive-polarity voltage and the negative-polarity voltage, the selection circuit 233 selects the gray-scale voltage 232 that corresponds to the output terminal. For example, when the positive-polarity gray-scale voltage is output to the X1 terminal and the negative-polarity gray-scale voltage to the X2 terminal, the selection circuit 226 selects display data corresponding to the X1 terminal for the DAC circuit 228 and display data corresponding to the X2 terminal for the DAC circuit 229. And, the DAC circuits 228 and 229 generate the gray-scale voltage corresponding to the display data, the output amplifier circuit 231 amplifies the gray-scale voltage, and the selection circuit 233 selects the positive-polarity gray-scale voltage for the X1 terminal and the negative-polarity gray-scale voltage for the X2 terminal to drive the data lines of the liquid crystal panel 206. Conversely, when the negative-polarity gray-scale voltage is output to the X1 terminal and the positive-polarity gray-scale voltage to the X2 terminal, the selection circuit 226 selects display data corresponding to the X1 terminal for the DAC circuit 229 and display data corresponding to the X2 terminal for the DAC circuit 228. And, the DAC circuits 228 and 229 generate the gray-scale voltage corresponding to the display data, the output amplifier circuit 231 amplifies the gray-scale voltage, and the selection circuit 233 selects the negative-polarity gray-scale voltage for the X1 terminal and the positive-polarity gray-scale voltage for the X2 terminal to drive the data lines of the liquid crystal panel 206. Performing the same operation for the X3 and the following terminals executes the dot inversion driving operation in which the polarities of the neighboring or adjacent terminals are inverted each other.

In addition, as shown in FIG. 1, switching SW1–SW6 via the pre-charge timing signal 221 switches between the amplifier circuit and the voltage follower circuit, for output. In FIG. 1, AMP1 is an amplifier circuit which outputs the positive-polarity gray-scale voltage (charge current). Turning SW1 off, SW2 on, and SW3 on causes AMP1 to output the pre-charge voltage generated by amplifying the gray-scale voltage 230 by a factor of (1+RL1/RG1). Conversely, turning SW1 on, SW2 off, and SW3 off causes AMP1 to serve as a voltage follower circuit which amplifies the gray-scale voltage 230 by a factor of 1 and to output the gray-scale voltage with no amplification. FIG. 9 shows the driving voltage waveform generated at this time. Similarly, AMP2 is an amplifier circuit which outputs the negative-polarity gray-scale voltage (discharge current). Turning SW4 off, SW5 on, and SW6 on causes AMP2 to output the pre-charge voltage generated by amplifying the gray-scale voltage 230 by a factor of (1+RL2/RV2)Vin−(RL2/RV2)VCC. Conversely, turning SW4 on, SW5 off, and SW6 off causes AMP2 to act as a voltage follower circuit which amplifies the gray-scale voltage 230 by a factor of 1 and to output the gray-scale voltage with no amplification. FIG. 10 shows the driving voltage waveform generated at this time.

In this way, applying a high voltage at a positive-polarity write time, and a low voltage at a negative-polarity write time, with respect to the predetermined gray-scale voltage during the pre-charge period allows data to be written into the liquid crystal panel at a high speed. In addition, because the pre-charge voltage is applied through the amplifier circuit, data may be written at a high speed even at a gray-scale voltage near the power supply voltage.

Next, another embodiment will be described with reference to FIGS. 2, 3, 9, and 10. The configuration of the output amplifier shown in FIG. 3 differs from that of the output amplifier shown in FIG. 1.

Figure 3:
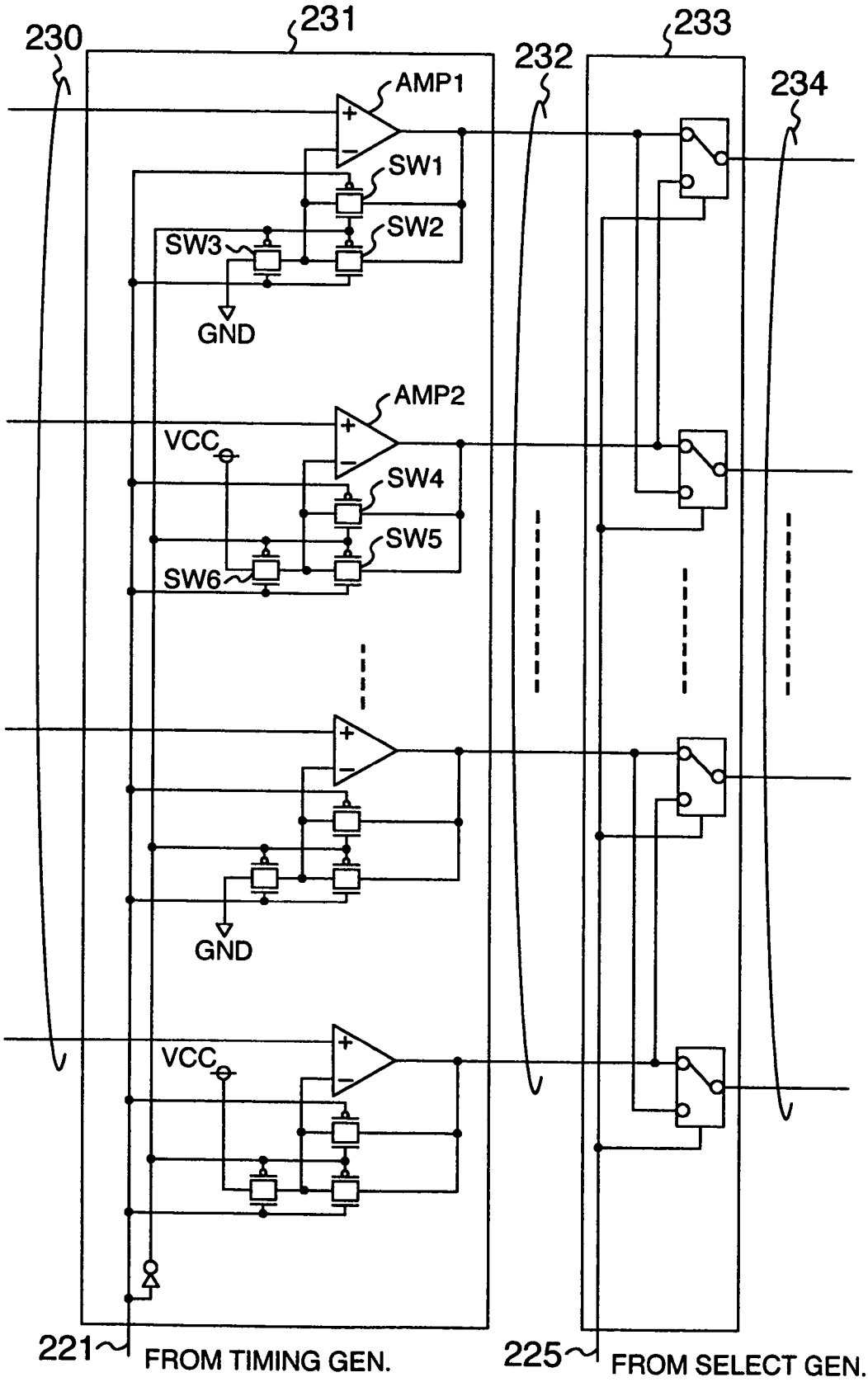
FIG. 3 is a block diagram showing an output amplifier circuit to which the present invention is applied.

The operation that is performed before the signal reaches the positive-polarity DAC circuit 228 and the negative-polarity DAC circuit 229 shown in FIG. 2 is the same as described above. The output amplifier circuit 231 shown in FIG. 3 switches SW1–SW6 via the pre-charge timing signal 221 to switch between the amplifier circuit and the voltage follower circuit for output. In FIG. 3, AMP1 is an amplifier circuit which outputs the positive-polarity gray-scale voltage (charge current). When the on-resistance of SW2 is RONL1 and the on-resistance of SW3 is RONG1, turning SW1 off, SW2 on, and SW3 on causes AMP1 to output the pre-charge voltage generated by amplifying the gray-scale voltage 230 by a factor of (1+RONL1/RONG1). Conversely, turning SWl on, SW2 off, and SW3 off causes AMP1 to serve as a voltage follower circuit which amplifies the gray-scale voltage 230 by a factor of 1 and to output the gray-scale voltage with no amplification. FIG. 9 shows the driving voltage waveform generated at this time. Similarly, AMP2 is an amplifier circuit which outputs the negative-polarity gray-scale voltage (discharge current). When the on-resistance of SW5 is RONL2 and the on-resistance of SW6 is RONV2, turning SW4 off, SW5 on, and SW6 on causes AMP2 to output the pre-charge voltage generated by amplifying the gray-scale voltage 230 by a factor of (1+RONL2/RONV2)Vin−(RONL2/RONV2)VCC. Conversely, turning SW4 on, SW5 off, and SW6 off causes AMP2 to act as a voltage follower circuit which amplifies the gray-scale voltage 230 by a factor of 1 and to output the gray-scale voltage with no amplification. FIG. 10 shows the driving voltage waveform generated at this time.

In this way, with the use of a MOS transistor circuit providing both the selection switch function and the resistor element function, applying a high voltage at a positive-polarity write time, and a low voltage at a negative-polarity write time, with respect to the predetermined gray-scale voltage during the pre-charge period allows data to be written into the liquid crystal panel at a high speed. In addition, because the pre-charge voltage is applied through the amplifier circuit, data may be written at a high speed even at a gray-scale voltage near the power supply voltage.

Next, an embodiment of the dot inversion drive method of a liquid crystal display will be described with reference to FIGS. 4, 5, 9, and 10.

Figure 4:
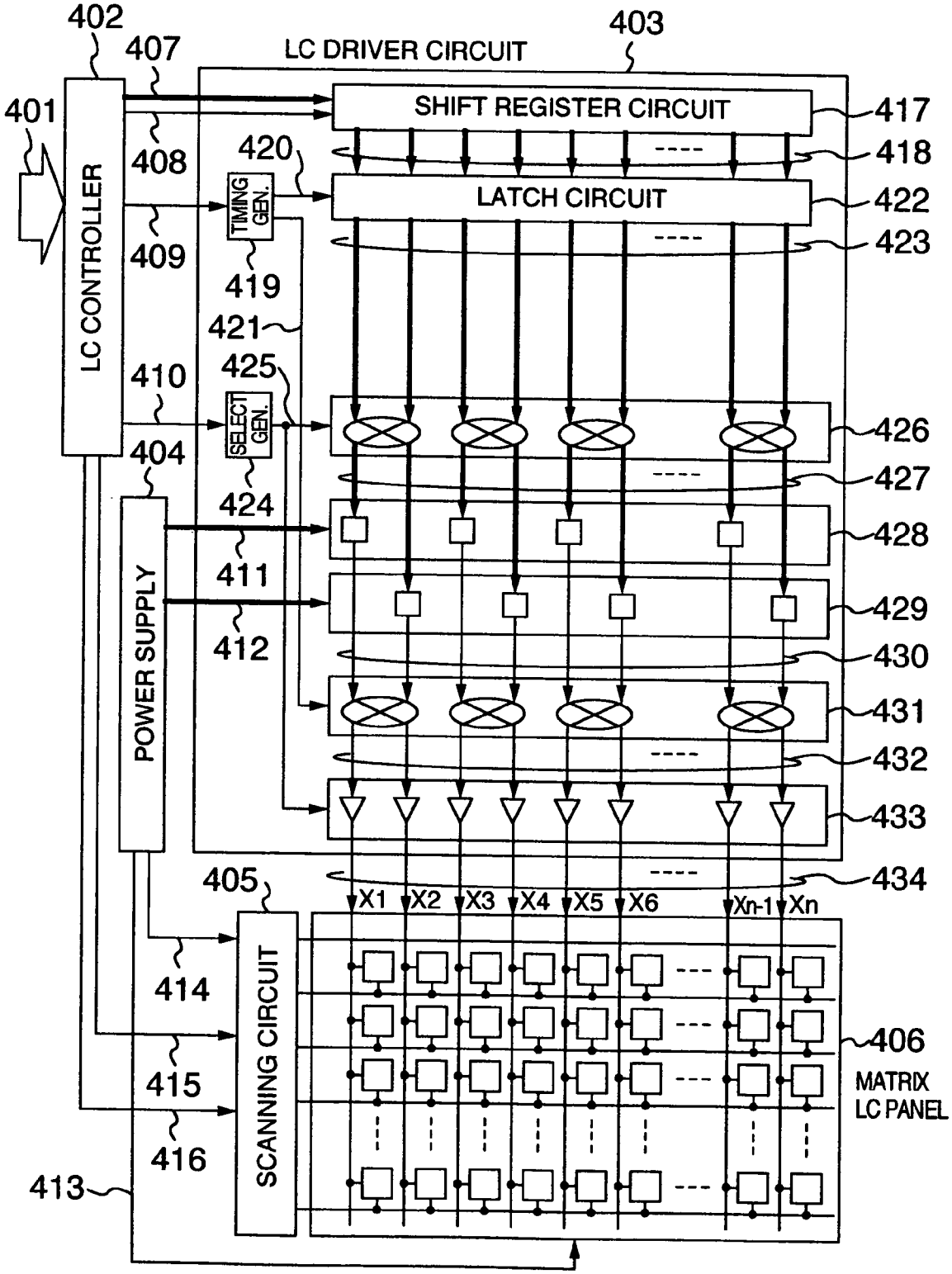
FIG. 4 is a block diagram showing an embodiment of an LCD.
Figure 5:
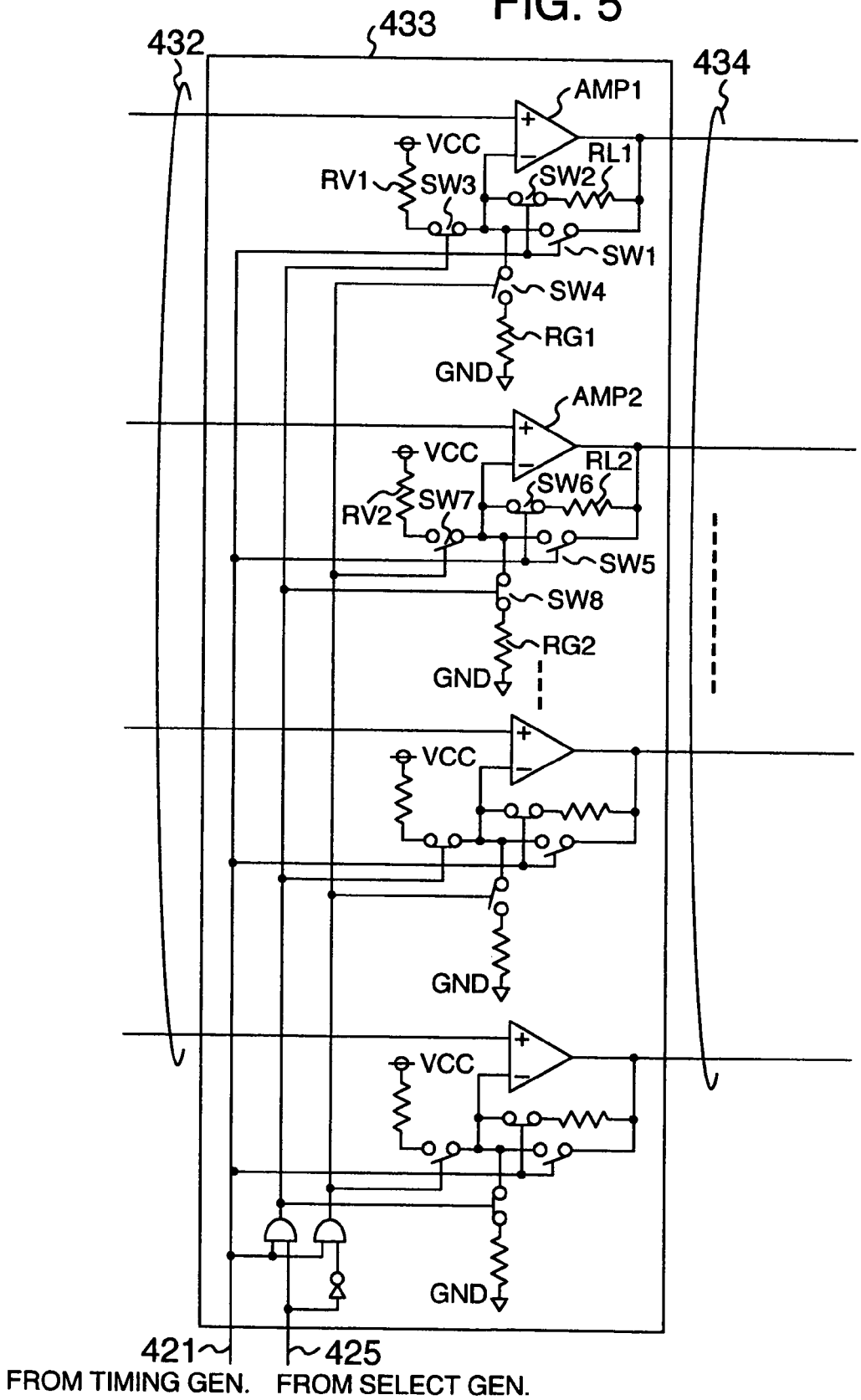
FIG. 5 is a block diagram showing an output amplifier circuit to which the present invention is applied.

FIG. 5 shows a configuration of an output circuit within a liquid crystal driver circuit, and FIG. 4 shows a configuration of the liquid crystal driver circuit. Numeral 401 indicates a display signal set transferred from a system unit, numeral 402 indicates a liquid crystal controller which converts the display signal set 401 to the synchronizing signal and display data of a liquid crystal driver circuit, numeral 403 indicates a liquid crystal driver circuit which applies a driving voltage corresponding to the display data to the liquid crystal panel, numeral 404 indicates a power supply circuit which generates the gray-scale voltage and reference voltage of the liquid crystal panel, numeral 405 indicates a scanning circuit which performs line-sequential selection for the liquid crystal panel, and numeral 406 indicates an active matrix liquid crystal panel. Numeral 407 indicates display data converted for use by the liquid crystal driver circuit, numeral 408 indicates a data transmission clock synchronizing with the display data 407, numeral 409 indicates a horizontal synchronizing signal which indicates the horizontal period, numeral 410 indicates an alternately switching signal which indicates the alternately switching timing of liquid crystal driving, numeral 411 indicates a positive-polarity gradation reference voltage whose alternately switching polarity of the liquid crystal driving voltage is positive, numeral 412 indicates a negative-polarity gradation reference voltage whose alternately switching polarity of the liquid crystal driving voltage is negative, numeral 413 indicates a common polarity voltage Vcom which is the reference voltage of the common polarity of the liquid crystal panel, numeral 414 indicates the scan reference voltage of the scan driving voltage output by the scanning circuit, numeral 415 indicates a frame synchronizing signal which indicates a frame period, and numeral 416 indicates a scan horizontal synchronizing signal which indicates the scan horizontal period timing.

Numeral 417 indicates a shift register circuit which sequentially acquires display data within the liquid crystal driver circuit 403, numeral 418 indicates a display data bus to which data is output from the shift register, numeral 419 indicates a control circuit which generates a timing signal for use in the liquid crystal driver circuit from the horizontal synchronizing signal 409, numeral 420 indicates a horizontal latch signal which latches the display data of the display data bus 418 to a latch circuit 422 at the same time, numeral 421 indicates a pre-charge timing signal which indicates the pre-charge period of an output amplifier circuit 433, numeral 423 indicates the output data from the latch circuit 422, numeral 424 indicates a control circuit which generates a selection signal 425 from the alternately switching signal 410, numeral 426 indicates a selection circuit which selects the display data of an output terminal corresponding to a neighboring pixel, numeral 427 indicates selection data, numeral 428 indicates a DAC circuit which generates a positive-polarity gray-scale voltage corresponding to the selection data 427, numeral 429 indicates a DAC circuit which generates a negative-polarity gray-scale voltage corresponding to the selection data 427, numeral 430 indicates a gray-scale voltage generated by the DAC circuits 428 and 429, numeral 431 indicates a selection circuit which selects the gray-scale voltage corresponding to the neighboring output terminal, numeral 432 indicates the gray-scale voltage selected by a selection circuit 433, numeral 433 indicates an output amplifier circuit, and numeral 434 indicates a liquid crystal application voltage.

FIG. 5 shows the detailed circuit configuration of the output amplifier circuit 431. Unlike the paired amplifier configuration of the first embodiment in FIG. 1, one amplifier circuit outputs one output. For example, in AMP1, three switches, SW1, SW2, and SW3, are switched to perform the amplification function and the voltage follower function.

Next, the liquid crystal panel driving operation will be described. In FIG. 4, in response to the display signal set 401 sent from a system unit (not shown) such as a personal computer, the liquid crystal controller 402 generates the timing signal and the control signal for the liquid crystal driver circuit. The display data 407 is serially sent to the liquid crystal driver circuit 403, two RGB pixels at a time, in synchronization with the data transmission clock 408. When the number of output gradations of the liquid crystal driver circuit 403 is 256, a total of 48 bits (8-bit RGB×2 pixels) of display data are sequentially sent. The liquid crystal driver circuit 403 sequentially acquires the display data 407 on the data transmission clock 408 to form one line of display data. One line of data, once acquired, is latched by the horizontal latch signal 420 to the latch circuit 422, one line at a time, during the horizontal period. The selection circuit 426 selects the display data of two pixels corresponding to the neighboring output in accordance with the alternately switching timing. The DAC circuit 428 generates the positive-polarity gray-scale voltage, while the DAC circuit 429 generates the negative-polarity gray-scale voltage. Therefore, the selection circuit 426 selects display data depending upon whether the neighboring output is in the positive polarity or negative polarity. Because the output amplifier circuit 433 outputs any of the positive-polarity voltage and the negative-polarity voltage, the selection circuit 431 selects the gray-scale voltage 430 that corresponds to the output terminal. For example, when the positive-polarity gray-scale voltage is output to the X1 terminal and the negative-polarity gray-scale voltage to the X2 terminal, the selection circuit 426 selects display data corresponding to the X1 terminal for the DAC circuit 428 and display data corresponding to the X2 terminal for the DAC circuit 429. And, the DAC circuits 428 and 429 generate the gray-scale voltage corresponding to the display data, the selection circuit 431 selects the positive-polarity gray-scale voltage for the X1 terminal and the negative-polarity gray-scale voltage for the X2 terminal, and the output amplifier circuit 431 amplifies the gray-scale voltage to drive the data lines of the liquid crystal panel 406. Conversely, when the negative-polarity gray-scale voltage is output to the X1 terminal and the positive-polarity gray-scale voltage to the X2 terminal, the selection circuit 426 selects display data corresponding to the X1 terminal for the DAC circuit 429 and display data corresponding to the X2 terminal for the DAC circuit 428. And, the DAC circuits 428 and 429 generate the gray-scale voltage corresponding to the display data, the selection circuit 431 selects the negative-polarity gray-scale voltage for the X1 terminal and the positive-polarity gray-scale voltage for the X2 terminal, and the output amplifier circuit 433 amplifies the gray-scale voltage to drive the data lines of the liquid crystal panel 406. Performing the same operation for the X3 and the following terminals executes the dot inversion driving operation in which the polarities of the neighboring or adjacent terminals are inverted each other. In addition, as shown in FIG. 5, switching SW1–SW8 via the pre-charge timing signal 421 switches the circuit between the amplifier circuit and the voltage follower circuit for output. In FIG. 5, AMP1 is an amplifier circuit which outputs both the positive-polarity and the negative-polarity gray-scale voltages (charge and discharge current). Turning SW1 off, SW2 on, SW3 on, and SW4 off causes AMP1 to output the pre-charge voltage generated by amplifying the gray-scale voltage 432 by a factor of (1+RL1/RV1)Vin−(RL2/RV2)VCC. Conversely, turning SW1 on, SW2 off, SW3 off, and SW4 off causes AMP1 to serve as a voltage follower circuit which amplifies the gray-scale voltage 432 by a factor of 1 and to output the gray-scale voltage with no amplification. FIG. 10 shows the driving voltage waveform generated at this time. Similarly, AMP2, with the configuration similar to that of AMP1, is an amplifier circuit which outputs both the positive-polarity and negative-polarity gray-scale voltages (charge and discharge current). When AMP1 outputs the negative-polarity gray-scale voltage, turning SW5 off, SW6 on, SW7 off, and SW8 on causes AMP2 to output the positive-polarity gray-scale voltage. At this time, AMP2 outputs the pre-charge voltage generated by amplifying the gray-scale voltage 432 by a factor of (1+RL2/RG2)Vin. Conversely, turning SW5 on, SW6 off, SW7 off, and SW8 off causes AMP2 to serve as a voltage follower circuit which amplifies the gray-scale voltage 432 by a factor of 1 and to output the gray-scale voltage with no amplification. FIG. 9 shows the driving voltage waveform generated at this time.

In this way, applying a high voltage at a positive-polarity write time, and a low voltage at a negative-polarity write time, with respect to the predetermined gray-scale voltage during the pre-charge period allows data to be written into the liquid crystal panel at a high speed. In addition, because the pre-charge voltage is applied through the amplifier circuit, data may be written at a high speed even at a gray-scale voltage near the power supply voltage.

Next, the LCD will be described with reference to FIGS. 4, 6, 9, and 10.

Figure 6:
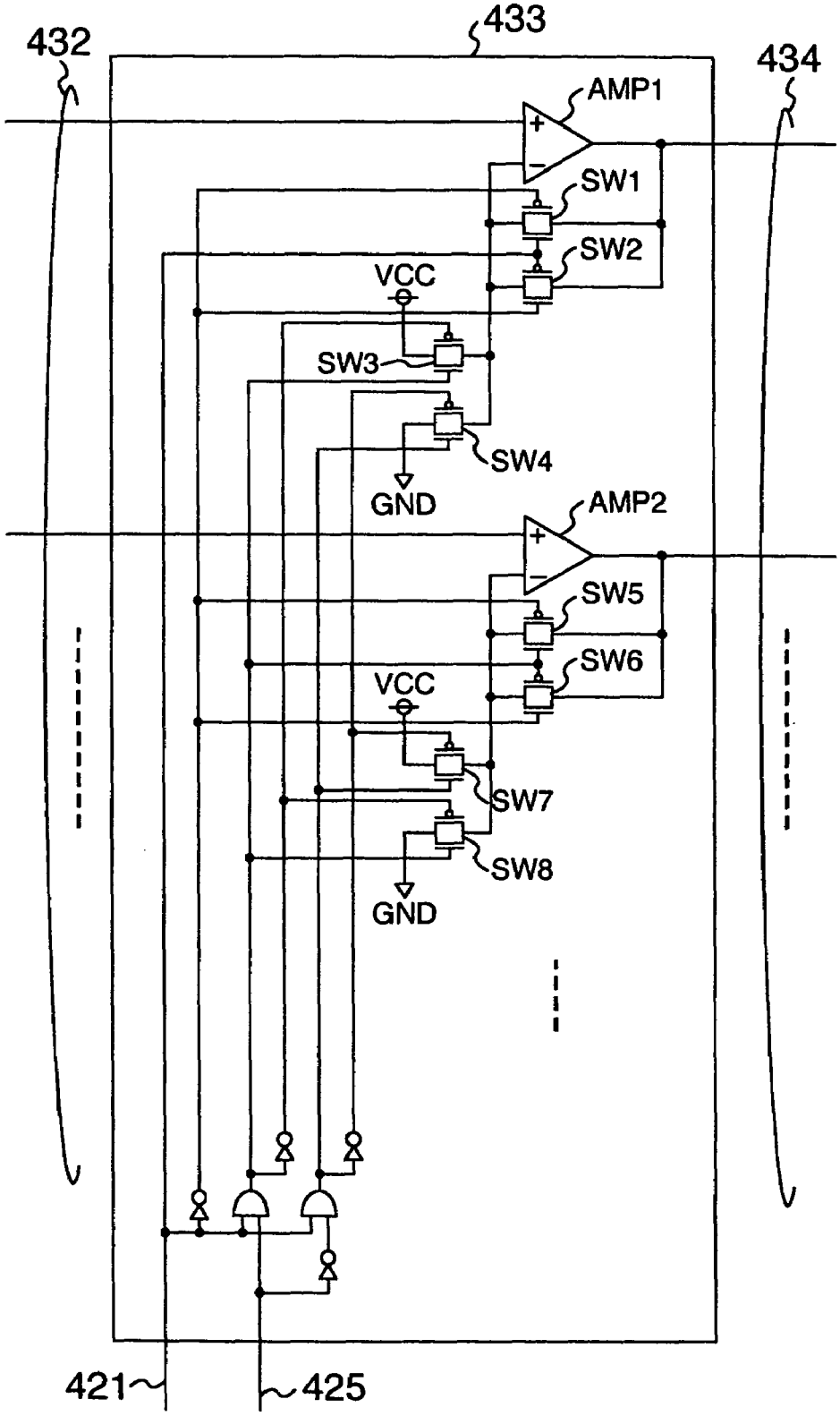
FIG. 6 is a block diagram showing an output amplifier circuit to which the present invention is applied.

FIG. 6 shows another embodiment of the output amplifier circuit shown in FIG. 5. The operation that is performed before the signal reaches the positive-polarity DAC circuit 428 and the negative-polarity DAC circuit 429 shown in FIG. 4 is the same as described above. As shown in FIG. 6, the pre-charge timing signal 421 switches SW1–SW8 to switch the amplifier circuit for amplification and the voltage follower circuit for output. FIG. 6 shows the detailed configuration of the output amplifier circuit. In FIG. 6, AMP1 is an amplifier circuit which outputs both the positive-polarity and negative-polarity gray-scale voltages (charge and discharge current). When the on-resistance of SW2 is RONL1 and the on-resistance of SW3 is RONV1, turning SW1 off, SW2 on, SW3 on, and SW4 off causes AMP1 to output the pre-charge voltage generated by amplifying the gray-scale voltage 432 by a factor of (1+RONL2/RONV2)Vin−(RONL2/RONV2)VCC. Conversely, turning SW1 on, SW2 off, SW3 off, and SW4 off causes AMP1 to serve as a voltage follower circuit which amplifies the gray-scale voltage 432 by a factor of 1 and to output the gray-scale voltage with no amplification. FIG. 10 shows the driving voltage waveform generated at this time. Similarly, AMP2, with the configuration identical to that of AMP1, is an amplifier circuit which outputs both the positive-polarity and negative-polarity gray-scale voltages (charge and discharge current). When AMP1 outputs the negative-polarity gray-scale voltage, turning SW5 off, SW6 on, SW7 off, and SW8 on outputs the positive-polarity gray-scale voltage. At this time, when the on-resistance of SW5 is RONL2 and the on-resistance of SW8 is RONG2, AMP2 outputs the pre-charge voltage generated by amplifying the gray-scale voltage 432 by a factor of (1+RONL1/RONG1)Vin. Conversely, turning SW5 on, SW6 off, DW7 off, and SW8 off causes AMP2 to serve as a voltage follower circuit which amplifies the gray-scale voltage 432 by a factor of 1 and to output the gray-scale voltage with no amplification. FIG. 9 shows the driving voltage waveform generated at this time.

In this way, with the use of a MOS transistor circuit providing both the selection switch function and the resistor element function, applying a high voltage at a positive-polarity write time, and a low voltage at a negative-polarity write time, with respect to the predetermined gray-scale voltage during the pre-charge period allows data to be written into the liquid crystal panel at a high speed. In addition, because the pre-charge voltage is applied through the amplifier circuit, data may be written at a high speed even at a gray-scale voltage near the power supply voltage.

Figure 7:
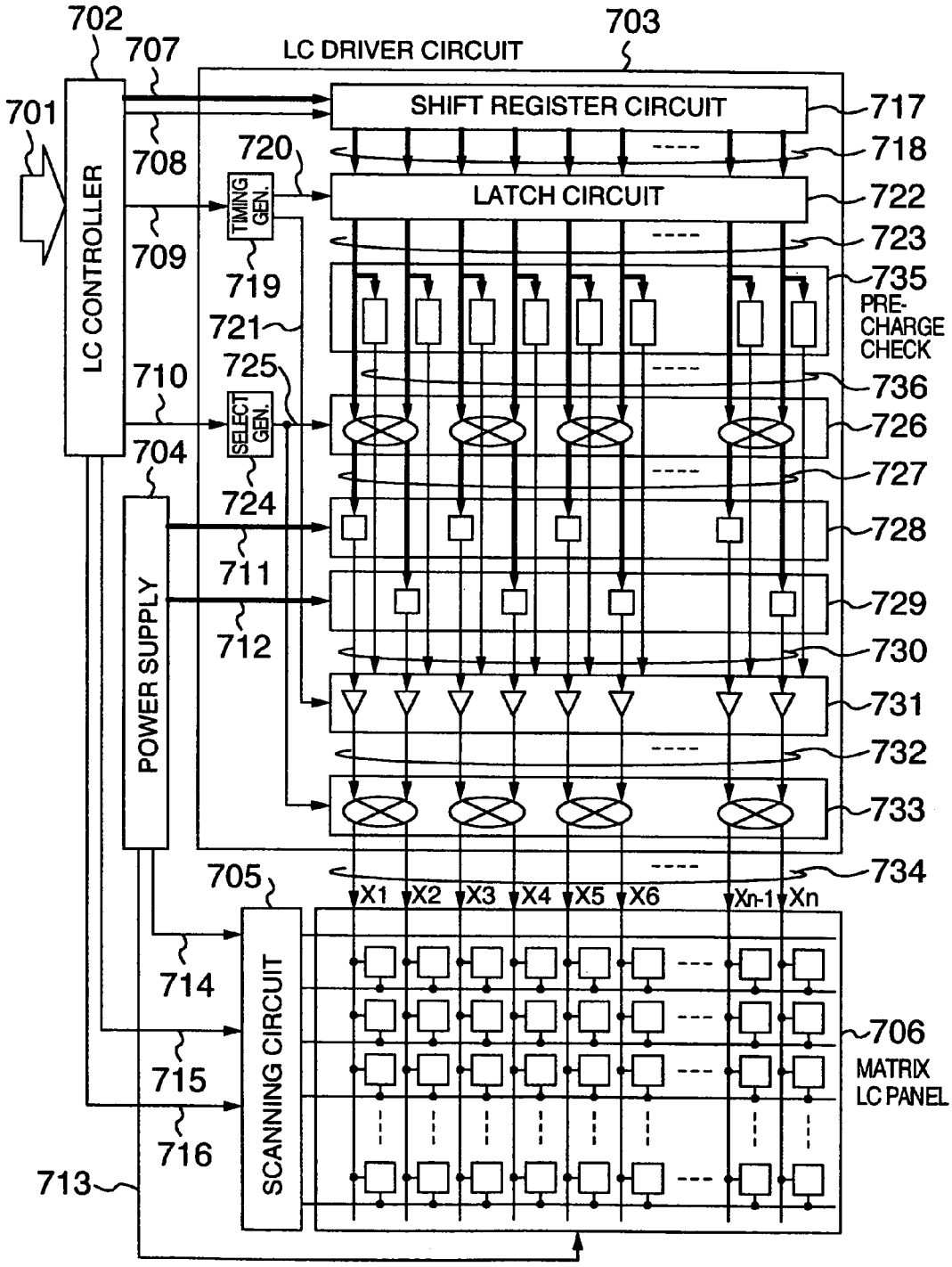
FIG. 7 is a block diagram showing an embodiment of an LCD.
Figure 8:
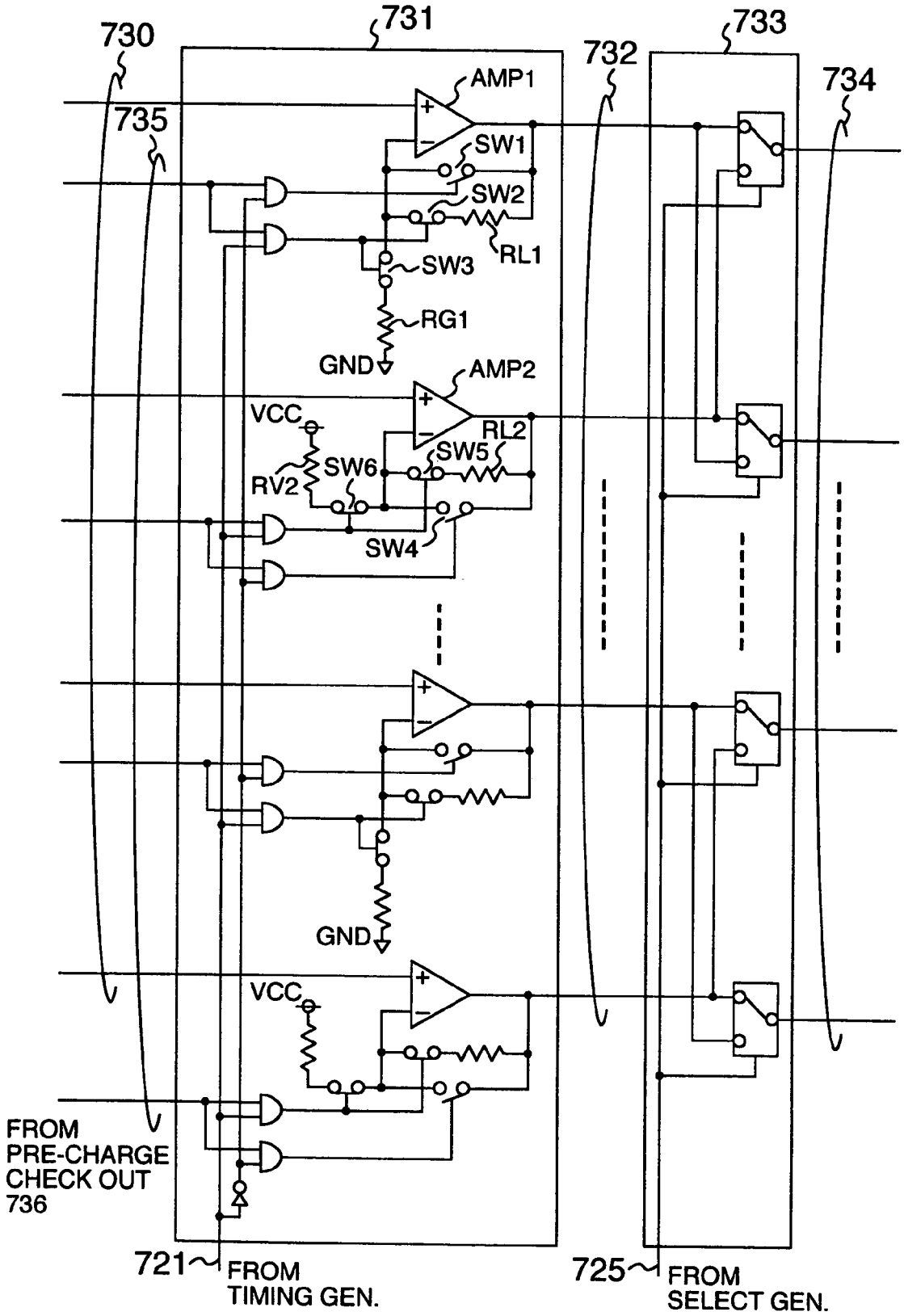
FIG. 8 is a block diagram showing an output amplifier circuit to which the present invention is applied.

Next, an embodiment in which the dot inversion drive of a liquid crystal display is implemented will be described with reference to FIGS. 7, 8, 9, 10, and 11. This embodiment differs from the above embodiments in that whether or not pre-charge control is performed is determined by the gray-scale voltage. FIG. 8 shows a configuration of an output circuit within a liquid crystal driver circuit, and FIG. 7 shows a configuration of the liquid crystal driver circuit. In FIG. 8, numeral 701 indicates a display signal set transferred from a system unit, numeral 702 indicates a liquid crystal controller which converts the display signal set 701 to the synchronizing signal and display data of a liquid crystal driver circuit, numeral 703 indicates a liquid crystal driver circuit which applies a driving voltage corresponding to the display data to the liquid crystal panel, numeral 704 indicates a power supply circuit which generates the gray-scale voltage and reference voltage of the liquid crystal panel, numeral 705 indicates a scanning circuit which performs line-sequential selection for the liquid crystal panel, and numeral 706 indicates an active matrix liquid crystal panel. Numeral 707 indicates display data converted for use by the liquid crystal driver circuit, numeral 708 indicates a data transmission clock synchronizing with the display data 707, numeral 709 indicates a horizontal synchronizing signal which indicates the horizontal period, numeral 710 indicates an alternately switching signal which indicates the alternately switching timing of liquid crystal driving, numeral 711 indicates a positive-polarity gradation reference voltage whose alternately switching polarity of the liquid crystal driving voltage is positive, numeral 712 indicates a negative-polarity gradation reference voltage whose alternately switching polarity of the liquid crystal driving voltage is negative, numeral 713 indicates a common polarity voltage Vcom which is the reference voltage of the common polarity of the liquid crystal panel, numeral 714 indicates the scan reference voltage of the scan driving voltage output by the scanning circuit, numeral 715 indicates a frame synchronizing signal which indicates a frame period, and numeral 716 indicates a scan horizontal synchronizing signal which indicates the scan horizontal period timing. Numeral 717 indicates a shift register circuit which sequentially acquires display data within the liquid crystal driver circuit 703, numeral 718 indicates a display data bus to which data is output from the shift register, numeral 719 indicates a control circuit which generates a timing signal for use in the liquid crystal driver circuit from the horizontal synchronizing signal 709, numeral 720 indicates a horizontal latch signal which latches the display data of the display data bus 718 to a latch circuit 722 at the same time, numeral 721 indicates a pre-charge timing signal which indicates the pre-charge period of an output amplifier circuit 733, numeral 723 indicates the output data from the latch circuit 722, numeral 724 indicates a control circuit which generates a selection signal 725 from the alternately switching signal 710, numeral 735 indicates a pre-charge control circuit by which to determine the condition for pre-charge control, numeral 736 indicates a pre-charge validity signal, numeral 726 indicates a selection circuit which selects the display data of an output terminal corresponding to a neighboring pixel, numeral 727 indicates selection data, numeral 728 indicates a DAC circuit which generates a positive-polarity gray-scale voltage corresponding to the selection data 727, numeral 729 indicates a DAC circuit which generates a negative-polarity gray-scale voltage corresponding to the selection data 727, numeral 730 indicates a gray-scale voltage generated by the DAC circuits 728 and 729, numeral 731 indicates an output amplifier circuit, numeral 732 indicates a gray-scale voltage, numeral 733 indicates a selection circuit which selects the gray-scale voltage corresponding to the neighboring output terminal, and numeral 734 indicates a liquid crystal application voltage.

FIG. 8 shows the detailed circuit configuration of the output amplifier circuit 731. Two-output paired amplifier circuits are selected by the selection circuit 733 for output. In FIG. 8, the output amplifier circuit is switched to execute the amplification function or the voltage follower function by switching three switches, SW1, SW2, and SW3. In addition, the circuit shown in FIG. 8 is designed to prevent an overshoot that may occur during the pre-charge period.

Next, the liquid crystal panel driving operation in this embodiment will be described. In FIG. 7, in response to the display signal set 701 sent from a system unit (not shown) such as a personal computer, the liquid crystal controller 702 generates the timing signal and the control signal for the liquid crystal driver circuit. The display data 707 is serially sent to the liquid crystal driver circuit 703, two RGB pixels at a time, in synchronization with the data transmission clock 708. When the number of output gradations of the liquid crystal driver circuit 703 is 256, a total of 48 bits (8-bit RGB×2 pixels) of display data are sequentially sent. The liquid crystal driver circuit 703 sequentially acquires the display data 707 on the data transmission clock 708 to form one line of display data. One line of data, once acquired, is latched by the horizontal latch signal 720 to the latch circuit 722, one line at a time, during the horizontal period. The pre-charge control circuit 735 checks the display data 723 of each output to decide whether to perform pre-charging corresponding to the gray-scale voltage shown in FIG. 11 and generates the pre-charge validity signal 736.

The pre-charge validity signal is generated by decoding the high-order two bits of 8-bit display data. For example, out of 256 gradations from gradations 1–256, pre-charging is performed not for gradations 1–64 but for gradations 65–256.

The selection circuit 726 selects the display data of two pixels corresponding to the neighboring output in accordance with the alternately switching timing. The DAC circuit 728 generates the positive-polarity gray-scale voltage, while the DAC circuit 729 generates the negative-polarity gray-scale voltage. Therefore, the selection circuit 726 selects display data depending upon whether the neighboring output is in the positive polarity or negative polarity. Because the output amplifier circuit 731 outputs one of the positive-polarity voltage and the negative-polarity voltage, the selection circuit 733 selects the gray-scale voltage 732 that corresponds to the output terminal. For example, when the positive-polarity gray-scale voltage is output to the X1 terminal and the negative-polarity gray-scale voltage to the X2 terminal, the selection circuit 726 selects display data corresponding to the X1 terminal for the DAC circuit 728 and display data corresponding to the X2 terminal for the DAC circuit 729. And, the DAC circuits 728 and 729 generate the gray-scale voltage corresponding to the display data, the output amplifier circuit 731 amplifies the gray-scale voltage, and the selection circuit 733 selects the positive-polarity gray-scale voltage for the X1 terminal and the negative-polarity gray-scale voltage for the X2 terminal to drive the data lines of the liquid crystal panel 706. Conversely, when the negative-polarity gray-scale voltage is output to the X1 terminal and the positive-polarity gray-scale voltage to the X2 terminal, the selection circuit 726 selects display data corresponding to the X1 terminal for the DAC circuit 729 and display data corresponding to the X2 terminal for the DAC circuit 728. And, the DAC circuits 728 and 729 generate the gray-scale voltage corresponding to the display data, the output amplifier circuit 731 amplifies the gray-scale voltage, and the selection circuit 733 selects the negative-polarity gray-scale voltage for the X1 terminal and the positive-polarity gray-scale voltage for the X2 terminal to drive the data lines of the liquid crystal panel 706. Performing the same operation for the X3 and the following terminals executes the dot inversion driving operation in which the polarities of the neighboring or adjacent terminals are inverted each other.

Figure 11:
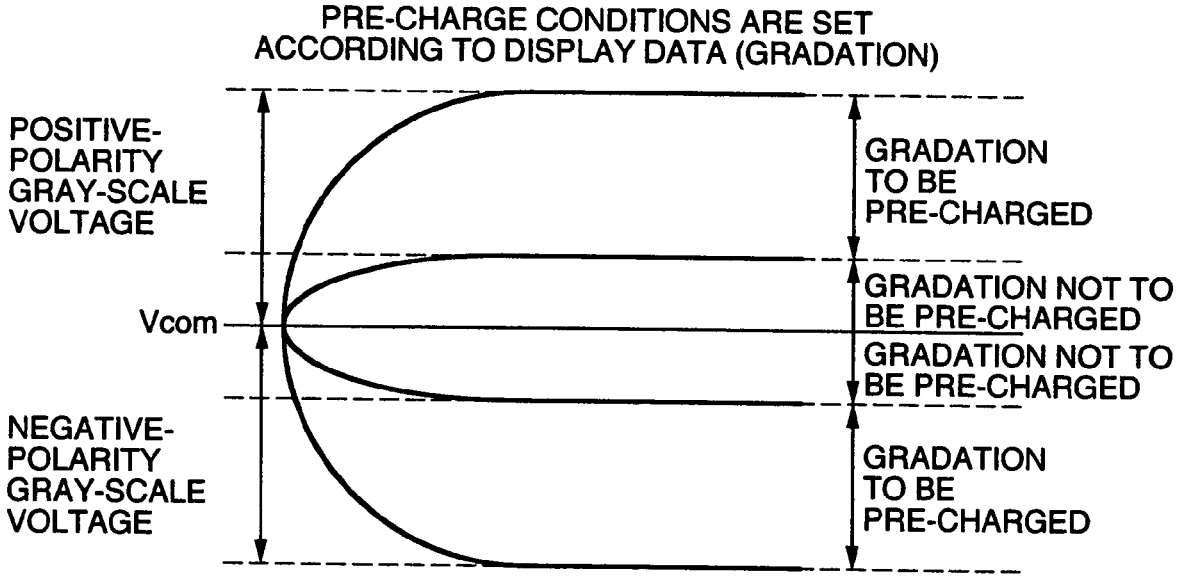
FIG. 11 is a diagram showing pre-charge conditions.

In addition, as shown in FIG. 8, switching SW1–SW6 via the pre-charge timing signal 721 and the pre-charge validity signal 736 switches the circuit between the amplifier circuit and the voltage follower circuit for output. In FIG. 8, AMP1 is an amplifier circuit which outputs the positive-polarity gray-scale voltage (charge current). Turning SW1 off, SW2 on, and SW3 on causes AMP1 to output the pre-charge voltage generated by amplifying the gray-scale voltage 730 by a factor of (1+RL1/RG1). Conversely, turning SW1 on, SW2 off, and SW3 off causes AMP1 to act as a voltage follower circuit which amplifies the gray-scale voltage 730 by a factor of 1 and to output the gray-scale voltage with no amplification. FIG. 9 shows the driving voltage waveform generated at this time. Similarly, AMP2 is an amplifier circuit which outputs the negative-polarity gray-scale voltage (discharge current). Turning SW4 off, SW5 on, and SW6 on causes AMP2 to output pre-charge voltage generated by amplifying the gray-scale voltage 730 by a factor of (1+RL2/RV2)Vin−(RL2/RV2)VCC. Conversely, turning SW4 on, SW5 off, and SW6 off causes AMP2 to act as a voltage follower circuit which amplifies the gray-scale voltage 730 by a factor of 1 and to output the gray-scale voltage with no amplification. FIG. 10 shows the driving voltage waveform generated at this time. As shown in FIG. 11, the pre-charge operation may be limited for the gray-scale voltage with a small write voltage amplitude corresponding to the gray-scale voltage (display data).

What is claimed is:

1. The display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, and a control circuit to control said precharge voltage based on a value of said display data, wherein said driver circuit provides said precharge voltage to said pixel portions prior to providing the gray-scale voltage corresponding to said display data, during one period of scan horizontal periods in which said scanning circuit scans said pixel portions, wherein the polarity of said gray-scale voltage is equal to the polarity of said precharge voltage, and, wherein said driver circuit includes an amplifier circuit to generate said precharge voltage by amplifying the gray-scale voltage corresponding to said display data in accordance with a signal from said control circuit.

2. The display device according to claim 1, wherein said control circuit determines whether said driver circuit should provide said precharge voltage based on the value of said display data, and wherein said driver circuit provides said precharge voltage when said control circuit determines that said driver circuit should provide said precharge voltage.

3. The display device according to claim 2, wherein said control circuit determines whether said driver circuit should provide said precharge voltage based on the value of upper bits of said display data.

4. The display device according to claim 2, wherein said control circuit determines that said driver circuit should provide said precharge voltage when the gray-scale voltage corresponding to said display data is higher than a predetermined value.

5. The display device according to claim 1, wherein, when said gray-scale voltage has a positive polarity, said precharge voltage is higher than the gray-scale voltage corresponding to said display data, and when said gray-scale voltage has a negative polarity, said precharge voltage is lower than the gray-scale voltage corresponding to said display data.

6. The display device according to claim 1, wherein a first period during which said driver circuit provides said precharge voltage during said one horizontal period is shorter than a second period during which said driver circuit provides the gray-scale voltage corresponding to said display data.

7. The display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, and a control circuit to control said precharge voltage based on a value of said display data, wherein said driver circuit provides said precharge voltage to said pixel portions prior to providing the gray-scale voltage corresponding to said display data, during one period of scan horizontal periods in which said scanning circuit scans said pixel portions, wherein the polarity of said gray-scale voltage is equal to the polarity of said precharge voltage, and, wherein said driver circuit includes a power supply circuit to generate said gray-scale voltage, and said driver circuit includes a digital-to-analog converter to select a gray-scale voltage corresponding to said display data, based on said gray-scale voltage generated from said power supply circuit, an amplifier circuit to amplify the gray-scale voltage corresponding said display data and a switch to select whether to amplify the gray-scale voltage corresponding to said display data, in accordance with a signal from said control circuit.

8. A display device according to claim 7, wherein said control circuit determines whether said driver circuit should provide said precharge voltage based on the value of said display data, and wherein said driver circuit provides said precharge voltage when said control circuit determines that said driver circuit should provide said precharge voltage.

9. A display device according to claim 8, wherein said control circuit determines whether said driver circuit should provide said precharge voltage based on the value of upper bits of said display data.

10. A display device according to claim 8, wherein said control circuit determines that said driver circuit should provide said precharge voltage when the gray-scale voltage corresponding to said display data is higher than a predetermined value.

11. A display device according to claim 7, wherein, when said gray-scale voltage has a positive polarity, said precharge voltage is higher than the gray-scale voltage corresponding to said display data, and when said gray-scale voltage has a negative polarity, said precharge voltage is lower than the gray-scale voltage corresponding to said display data.

12. A display device according to claim 7, wherein a first period during which said driver circuit provides said precharge voltage during said one horizontal period is shorter than a second period during which said driver circuit provides the gray-scale voltage corresponding to said display data.

13. A display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, and a control circuit to control ON or OFF of said precharge voltage, wherein said driver circuit provides said precharge voltage to said pixel portions prior to providing the gray-scale voltage corresponding to said display data, during one period of scan horizontal periods in which said scanning circuit scans said pixel portions, wherein the polarity of said gray-scale voltage is equal to the polarity of said precharge voltage, and wherein said driver circuit includes an amplifier circuit to generate said precharge voltage by amplifying the gray-scale voltage corresponding to said display data in accordance with a signal from said control circuit.

14. The display device comprising:

a display panel having a plurality of pixel portions arranged in a matrix;

scanning means for scanning lines of said pixel portions; and driving means for providing said pixel portions with a gray-scale voltage corresponding to display data and a precharge voltage different from the gray-scale voltage corresponding to said display data, and control means for controlling said precharge voltage based on a value of said display data, wherein said driving means provides said precharge voltage to said pixel portions prior to providing the gray-scale voltage corresponding to said display data, during one period of scan horizontal periods in which said scanning means scans said pixel portions, wherein the polarity of said gray-scale voltage is equal to the polarity of said precharge voltage, and wherein said driving means includes amplifier means for generating said precharge voltage by amplifying the gray-scale voltage corresponding to said display data in accordance with a signal from said control means.

15. The display device according to claim 14, wherein said control means determines whether said driving means should provide said precharge voltage based on the value of said display data, and wherein said driving means circuit provides said precharge voltage when said control means determines that said driving means should provide said precharge voltage.

16. The display device according to claim 15, wherein said control means determines whether said driving means should provide said precharge voltage based on the value of upper bits of said display data.

17. The display device according to claim 15, wherein said control means determines that said driving means should provide said precharge voltage when the gray-scale voltage corresponding to said display data is higher than a predetermined value.

18. The display device according to claim 14, wherein, when said gray-scale voltage has a positive polarity, said precharge voltage is higher than the gray-scale voltage corresponding to said display data, and when said gray-scale voltage has a negative polarity, said precharge voltage is lower than the gray scale voltage corresponding to said display data.

19. The display device according to claim 14, wherein a first period during which said driving means provides said precharge voltage during said one horizontal period is shorter than a second period during which said driving means provides the gray-scale voltage corresponding to said display data.

20. The display device comprising:

a display panel having a plurality of pixel portions arranged in a matrix;

scanning means for scanning lines of said pixel portions; and driving means for providing said pixel portions with a gray-scale voltage corresponding to display data and a precharge voltage different from the gray-scale voltage corresponding to said display data, and control means for controlling said precharge voltage based on a value of said display data, wherein said driving means provides said precharge voltage to said pixel portions prior to providing the gray-scale voltage corresponding to said display data, during one period of scan horizontal periods in which said scanning means scans said pixel portions, wherein the polarity of said gray-scale voltage is equal to the polarity of said precharge voltage, and wherein said driving means includes a power supply means for generating said gray-scale voltage, and said driving means includes a digital-to-analog converting means for selecting a gray-scale voltage corresponding to said display data, based on said gray-scale voltage generated from said power supply means, amplifier means for amplifying the gray-scale voltage corresponding said display data and a switching means for selecting whether to amplify the gray-scale voltage corresponding to said display data, in accordance with a signal from said control means.

21. A display device according to claim 20, wherein said control means determines whether said driving means should provide said precharge voltage based on the value of said display data, and wherein said driving means circuit provides said precharge voltage when said control means determines that said driving means should provide said precharge voltage.

22. A display device according to claim 21, wherein said control means determines whether said driving means should provide said precharge voltage based on the value of upper bits of said display data.

23. A display device according to claim 21, wherein said control means determines that said driving means should provide said precharge voltage when the gray-scale voltage corresponding to said display data is higher than a predetermined value.

24. A display device according to claim 20, wherein, when said gray-scale voltage has a positive polarity, said precharge voltage is higher than the gray-scale voltage corresponding to said display data, and when said gray-scale voltage has a negative polarity, said precharge voltage is lower than the gray scale voltage corresponding to said display data.

25. A display device according to claim 20, wherein a first period during which said driving means provides said precharge voltage during said one horizontal period is shorter than a second period during which said driving means provides the gray-scale voltage corresponding to said display data.

26. A display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, and a control circuit to control ON or OFF of said precharge voltage, wherein said driver circuit provides said precharge voltage to said pixel portions prior to providing the gray-scale voltage corresponding to said display data, during one period of scan horizontal periods in which said scanning circuit scans said pixel portions, and wherein the polarity of said gray-scale voltage is equal to the polarity of said precharge voltage, wherein said driver circuit includes a power supply circuit to generate said gray-scale voltage, and said driver circuit includes a digital-to-analog converter to select a gray-scale voltage corresponding to said display data, based on said gray- scale voltage generated from said power supply circuit, an amplifier circuit to amplify the gray-scale voltage corresponding said display data and a switch to select whether to amplify the gray-scale voltage corresponding to said display data, in accordance with a signal from said control circuit.

27. A display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, wherein said driver circuit provides said precharge voltage to said pixel portions prior to providing the gray-scale voltage corresponding to said display data, during one period of scan horizontal periods in which said scanning circuit scans said pixel portions, and wherein said driver circuit includes an amplifier circuit to generate said precharge voltage by changing an amplification factor of the gray-scale voltage corresponding to said display data.

28. A display device comprising:

a display panel having a plurality of pixel portions arranged in a matrix;

a scanning circuit to scan lines of said pixel portions; and a driver circuit to provide said pixel portions with a gray-scale voltage corresponding to display data and a precharge voltage different from the gray-scale voltage corresponding to said display data, and a control circuit to control said precharge voltage based on a value of said display data, wherein said driver circuit provides said precharge voltage to said pixel portions prior to providing the gray-scale voltage corresponding to said display data, during one period of scan horizontal periods in which said scanning circuit scans said pixel portions, wherein the polarity of said gray-scale voltage is equal to the polarity of said pre-charge voltage, and wherein said driver circuit includes an amplifier circuit to generate said precharge voltage by changing an amplification factor of the gray-scale voltage corresponding to said display data.

29. A display device according to claim 28, wherein said control circuit determines whether said driver circuit should provide said precharge voltage based on the value of said display data, and wherein said driver circuit provides said precharge voltage when said control circuit determines that said driver circuit should provide said precharge voltage.

30. A display device according to claim 29, wherein said control circuit determines that said driver circuit should provide said precharge voltage when the gray-scale voltage corresponding to said display data is higher than a predetermined value.

31. A display device according to claim 29, wherein said control circuit determines that said driver circuit should provide said precharge voltage when the gray-scale voltage corresponding to said display data is higher than a predetermined value.

32. A display device according to claim 28, wherein, when said gray-scale voltage has a positive polarity, said precharge voltage is higher than the gray-scale voltage corresponding to said display data, and when said gray-scale voltage has a negative polarity, said precharge voltage is lower than the gray-scale voltage corresponding to said display data.

33. A display device according to claim 28, wherein a first period during which said driver circuit provides said precharge voltage during said one horizontal period is shorter than a second period during which said driver circuit provides the gray-scale voltage corresponding to said display data.

* * * * *